US008453662B2

(12) United States Patent
Trout

(10) Patent No.: US 8,453,662 B2
(45) **Date of Patent: *Jun. 4, 2013**

(54) ASSISTIVE WALKER APPARATUS

(75) Inventor: William G. Trout, Elgin, IL (US)

(73) Assignee: Steelhead Innovations, LLC, Elgin, IL (US)

( * ) Notice: Subject to any disclaimer, the term of this patent is extended or adjusted under 35 U.S.C. 154(b) by 62 days.

This patent is subject to a terminal disclaimer.

(21) Appl. No.: 13/117,968

(22) Filed: May 27, 2011

(65) Prior Publication Data

US 2012/0085377 A1 Apr. 12, 2012

Related U.S. Application Data

(63) Continuation of application No. 12/901,538, filed on Oct. 10, 2010, now Pat. No. 7,963,294.

(51) Int. Cl.
*A45B 3/00* (2006.01)
*A61H 3/00* (2006.01)

(52) U.S. Cl.
USPC ..... 135/66; 135/67; 135/910

(58) Field of Classification Search
USPC ..... 135/65, 66, 67, 910
See application file for complete search history.

(56) References Cited

U.S. PATENT DOCUMENTS

| | | | | |
|---|---|---|---|---|
| 5,331,990 | A | 7/1994 | Hall et al. | |
| 5,477,211 | A | 12/1995 | Reynolds | |
| 5,636,651 | A | 6/1997 | Einbinder | |
| 5,853,219 | A | 12/1998 | Santuccio | |
| 6,011,481 | A | 1/2000 | Luther et al. | |
| 6,930,303 | B2 | 8/2005 | Hakamata | |
| 6,930,603 | B2 * | 8/2005 | Jackson | 340/539.12 |
| 2006/0292533 | A1 * | 12/2006 | Selod | 434/247 |
| 2007/0000531 | A1 | 1/2007 | Russo | |
| 2008/0042853 | A1 | 2/2008 | Dempsey | |
| 2009/0009320 | A1 * | 1/2009 | O'Connor et al. | 340/539.12 |
| 2009/0260426 | A1 * | 10/2009 | Lieberman et al. | 73/65.01 |

* cited by examiner

*Primary Examiner* — David Dunn
*Assistant Examiner* — Danielle Jackson
(74) *Attorney, Agent, or Firm* — Parsons & Goltry; Michael W. Goltry; Robert A. Parsons

(57) ABSTRACT

An assistive walker for assisting a user in going on foot and for reinforcing recommended walker use technique includes a walker frame including opposed leading and trailing ends formed between opposed handled and footed ends and that together define a user-receiving area extending from the trailing end of the walker frame to the leading end of the walker frame, and the walker frame is for supporting a user in the user-receiving area and aiding ambulation thereof. The walker frame is formed with a motion sensor apparatus including a motion sensor assembly to detect user movement at the user-receiving area, and a signal device operatively coupled to the motion sensor assembly to emit the signal in response to a substantial lack of detected user movement at the user-receiving area.

16 Claims, 10 Drawing Sheets

ASSISTIVE WALKER APPARATUS

FIELD OF THE INVENTION

The present invention relates ambulatory devices for assisting physically challenged users in going on foot.

BACKGROUND OF THE INVENTION

The prior art is replete with ambulatory devices that are designed to support and assist physically challenged users in walking, exercise or otherwise going on foot. Among the vast array of ambulatory devices, walkers and canes remain the most fundamental means of helping people move about their homes and communities and for helping patients move about hospitals and for helping the elderly move about nursing homes and other places. Although walkers and canes are notoriously known, relatively little attention has been directed toward improving not only the construction of such ambulatory devices, but also promoting proper use us such ambulatory devices, thus necessitating improvement in the art.

SUMMARY OF THE INVENTION

According to the principle of the invention, an assistive walker for assisting a user in going on foot and for reinforcing recommended walker use technique includes a walker frame formed with a motion sensor apparatus. The walker frame includes opposed leading and trailing ends formed between opposed handled and footed ends and that together define a user-receiving area extending from the trailing end of the walker frame to the leading end of the walker frame, and the walker frame is for supporting a user in the user-receiving area and aiding ambulation thereof. The motion sensor apparatus is operative to detect user movement at the user-receiving area and for emitting a signal in response to a substantial lack of detected user movement at the user-receiving area. The motion sensor apparatus includes a motion sensor assembly to detect user movement at the user-receiving area, and a signal device operatively coupled to the motion sensor assembly to emit the signal in response to the substantial lack of detected user movement at the user-receiving area. In one embodiment, the signal device includes a light. In another embodiment, the signal device includes an aural device for emitting a noise. In yet a further embodiment, the signal device includes a vibrator.

According to the principle of the invention, an assistive walker for assisting a user in going on foot and for reinforcing recommended walker use technique includes a walker frame formed with a motion sensor apparatus. In this embodiment, the walker frame includes opposed leading and trailing ends formed between opposed handled and footed ends and that together define a user-receiving area extending from the trailing end of the walker frame to the leading end of the walker frame, and the walker frame is for supporting a user in the user-receiving area and aiding ambulation thereof. The trailing end of the walker defines an opening to the user-receiving area, which opening extends from the handled end to the footed end to provide unobstructed user access therethrough to the user-receiving area. The motion sensor apparatus is operative to detect user movement at the opening to the user-receiving area and for emitting a signal in response to a substantial lack of detected user movement at the opening to the user-receiving area. The motion sensor apparatus includes a motion sensor assembly to detect user movement at the opening to the user-receiving area, and a signal device operatively coupled to the motion sensor assembly to emit the signal in response to the substantial lack of detected user movement at the opening to the user-receiving area. In one embodiment, the signal device includes a light. In another embodiment, the signal device includes an aural device for emitting a noise. In yet another embodiment, the signal device includes a vibrator.

According to the principle of the invention, an assistive walker for assisting a user in going on foot and for reinforcing recommended walker use technique includes a walker frame including opposed leading and trailing ends formed between opposed handled and footed ends and that together define a user-receiving area extending from the trailing end of the walker frame to the leading end of the walker frame, and the walker frame is for supporting a user in the user-receiving area and aiding ambulation thereof. The walker frame is formed with a motion sensor apparatus to detect user movement at the user-receiving area and for emitting a signal in response to a substantial lack of detected user movement at the user-receiving area. The motion sensor apparatus includes a motion sensor assembly to detect user movement at the user-receiving area, a console carried by the walker frame, and a signal device formed with the console operatively coupled to the motion sensor assembly to emit the signal in response to the substantial lack of detected user movement at the user-receiving area. In one embodiment, the signal device includes a light. In another embodiment, the signal device includes an aural device for emitting a noise.

According to the principle of the invention, an assistive walker for assisting a user in going on foot and for reinforcing recommended walker use technique includes a walker frame including opposed leading and trailing ends formed between opposed handled and footed ends and that together define a user-receiving area extending from the trailing end of the walker frame to the leading end of the walker frame, and the walker frame is for supporting a user in the user-receiving area and aiding ambulation thereof. The trailing end of the walker defines an opening to the user-receiving area extending from the handled end to the footed end to provide unobstructed user access therethrough to the user-receiving area. The walker frame is formed with a motion sensor apparatus to detect user movement at the opening to the user-receiving area and for emitting a signal in response to a substantial lack of detected user movement at the opening to the user-receiving area. The motion sensor apparatus includes a motion sensor assembly to detect user movement at the opening to the user-receiving area, a console carried by the walker frame, and a signal device formed with the console operatively coupled to the motion sensor assembly to emit the signal in response to the substantial lack of detected user movement at the opening to the user-receiving area. In one embodiment, the signal device includes a light. In another embodiment, the signal device includes an aural device for emitting a noise.

According to the principle of the invention, an assistive walker for assisting a user in going on foot and for reinforcing recommended walker use technique includes a walker frame including opposed leading and trailing ends formed between opposed handled and footed ends and that together define a user-receiving area extending from the trailing end of the walker frame to the leading end of the walker frame, and the walker frame is for supporting a user in the user-receiving area and aiding ambulation thereof. A motion sensor assembly is carried by the walker frame, and is operative to detect user movement at the user-receiving area. A console is carried by the walker frame, and is operatively coupled to the motion sensor assembly to emit a first signal in response to a substantial lack of detected user movement at the user-receiving area.

A signal device is wirelessly coupled to the console to receive the first signal and to emit an alarm in response thereto. In one embodiment, the signal device includes a light, and the alarm is an illumination emitted by the light. In another embodiment, the signal device includes an aural device, and the alarm is a noise emitted by the aural device. In yet another embodiment, the signal device includes a vibrator, and the alarm is a vibration emitted by the vibrator.

According to the principle of the invention, an assistive walker for assisting a user in going on foot and for reinforcing recommended walker use technique includes a walker frame including opposed leading and trailing ends formed between opposed handled and footed ends and that together define a user-receiving area extending from the trailing end of the walker frame to the leading end of the walker frame, and the walker frame is for supporting a user in the user-receiving area and aiding ambulation thereof. The trailing end of the walker frame defines an opening to the user-receiving area extending from the handled end to the footed end to provide unobstructed user access therethrough to the user-receiving area. A motion sensor assembly is carried by the walker frame, and is operative to detect user movement at the opening to the user-receiving area. A console is carried by the walker frame, and is operatively coupled to the motion sensor assembly to emit a first signal in response to a substantial lack of detected user movement at the opening to the user-receiving area. A signal device is wirelessly coupled to the console to receive the first signal and to emit an alarm in response thereto. In one embodiment, the signal device includes a light, and the alarm is an illumination emitted by the light. In another embodiment, the signal device includes an aural device, and the alarm is a noise emitted by the aural device. In yet another embodiment, the signal device includes a vibrator, and the alarm is a vibration emitted by the vibrator.

BRIEF DESCRIPTION OF THE DRAWINGS

Referring to the drawings.

DETAILED DESCRIPTION

The present invention provides an improved assistive walker of a type used to support a user in going on foot, such as young children learning to walk, convalescents and those who suffer lasting effects of injury and physical challenges and the elderly, and for promoting, encouraging, or otherwise reinforcing recommended walker use technique.

Figure 1:
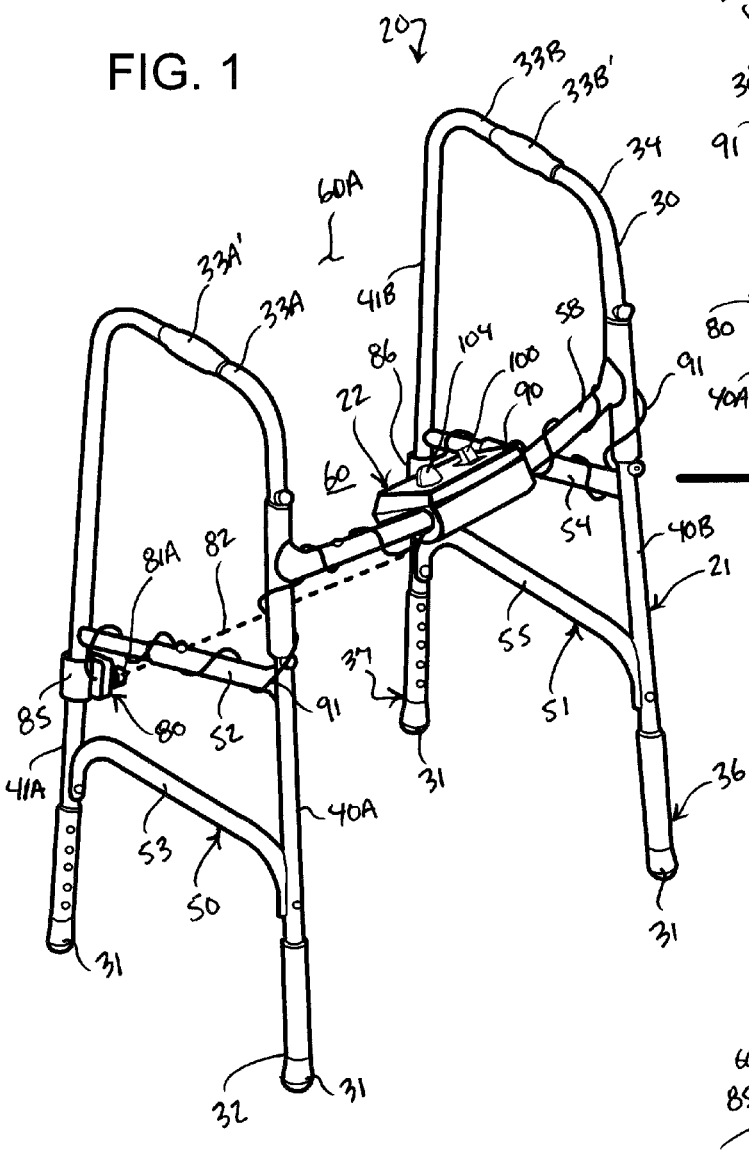
FIG. 1 is a perspective view of an assistive walker for assisting a user in going on foot and for reinforcing recommended walker use technique, the assistive walker constructed and arranged in accordance with the principle of the invention and including a walker frame formed with a motion sensor apparatus including a motion sensor assembly operative coupled to a signal device formed with a console mounted to the walker frame.
Figure 2:
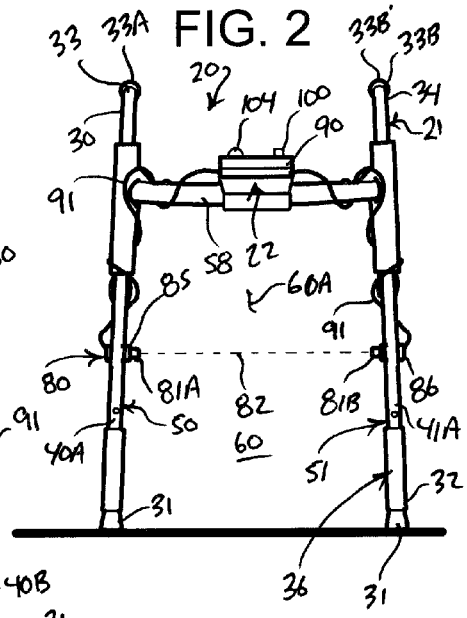
FIG. 2 is a front elevation view of the assistive walker of FIG. 1.
Figure 3:
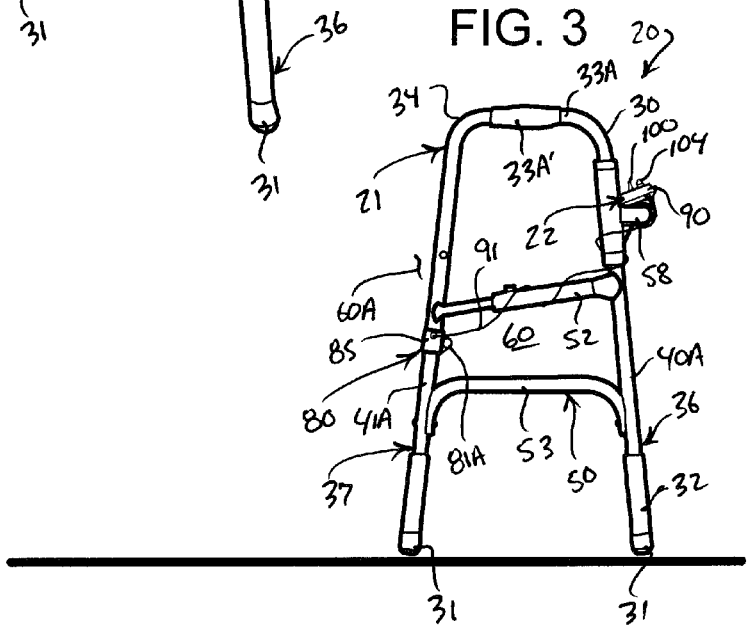
FIG. 3 is a side elevation view of the assistive walker of FIG. 1.

Turning now to the drawings, in which like reference characters indicate corresponding elements throughout the several views, attention is directed in relevant part to FIGS. 1-3 illustrating an assistive walker apparatus 20 including an assistive walker assembly or walker 21 for assisting a user in going on foot formed with a motion sensor apparatus 22 for promoting, encouraging or otherwise reinforcing recommended walker use technique in the use of walker 21. Walker 21 consists of a walker frame 30 formed largely of lightweight, substantially rigid tubular stock, such as tubular aluminum, plastic, or the like. Frame 30 supports feet 31 at one end 32 and handles 33A and 33B at an opposing end 34. End 32 is a lower end of walker 21, and end 34 is an upper end of walker 21. In this embodiment, frame 30 supports four feet 31 and two handles 33A and 33B. Handles 33A and 33B define handled ends of walker 21, are separated by a distance, and reside at approximately the same elevation for convenient take up by hand. Feet 31 define footed ends of walker 21, which engage the ground or supporting surface and are arranged in a substantially box-like, square or rectangular footprint for providing stability to a user. Frame 30 defines a leading end 36 and an opposed trailing end 37. To employ assistive walker apparatus 20, a user may stand along trailing end 37, grasp handles 33A and 33B with his hands and then walk while maneuvering and advancing assistive walker apparatus 20 to provide aid or support during the act of walking. Handles 33 have soft, resilient, rubber or rubber-like grips 33A' and 33B' that are easily taken up by hand and that provide comfortable gripping. In an alternate embodiment, feet 31 can be formed in total or in part with wheels to provide wheeled or partially wheeled movement of walker 21 across a surface in the use of walker 21 in the normal and customary manner.

Frame 30 has forward legs 40A and 40B, and opposed rearward legs 41A and 41B. Forward legs 40A and 40B and rearward legs 41A and 41B each support one of feet 31. Legs 40A and 41A each meet at and are connected by handle 33A at end 34 and together form a leg assembly denoted at 50, and legs 40B and 41B each meet at and are connected by handle 33B and together form a leg assembly denoted at 51. Forward and rearward legs 40A and 41A of leg assembly 50 are connected by upper and lower stretchers 52 and 53 formed between ends 32 and 34 of frame 30 and impart structural rigidity to leg assembly 50, and forward and rearward legs 40B and 41B of leg assembly 51 are connected by upper and lower stretchers 54 and 55 formed between ends 32 and 34 of frame 30 and impart structural rigidity to leg assembly 51. A rail 58 connects legs 40A and 41B of leg assemblies 50 and 51 together between ends 32 and 34 at leading end 36 of frame 30 tying or otherwise connecting leg assembly 50 to leg assembly 51.

In sum, frame 30 of walker 21 has opposed leading and trailing ends 36 and 37 formed between opposed handled and footed ends formed in leg assemblies 50 and 51, and together define a user-receiving area 60 extending from trailing end 37 of frame 30 to leading end 36 of frame 30 between leg assemblies 50 and 51, and frame 30 is for supporting a user in user-receiving area 60 and aiding ambulation thereof. Trailing end 37 of frame 30 defines an opening 60A to user-receiving area 60, which extends between rearward legs 40B and 41B of leg assemblies 50 and 51 from the handled end of walker 21 formed in end 34 of frame 30 to the footed end of walker 21 formed in end 32 of frame 30 to provide unobstructed user access therethrough to user-receiving area 60. Opening 60A is considered part of, or otherwise an extension of, user-receiving area 60. In an alternate embodiment, feet 31 can be formed in total or in part with wheels to provide wheeled or partially wheeled movement of walker 21 across a surface in the use of walker 21 in the normal and customary manner. Walker 21 is formed with four legs 40A and 40B, and 41A and 41B, and it may be formed with less or more as may be needed or desired.

Figure 6:
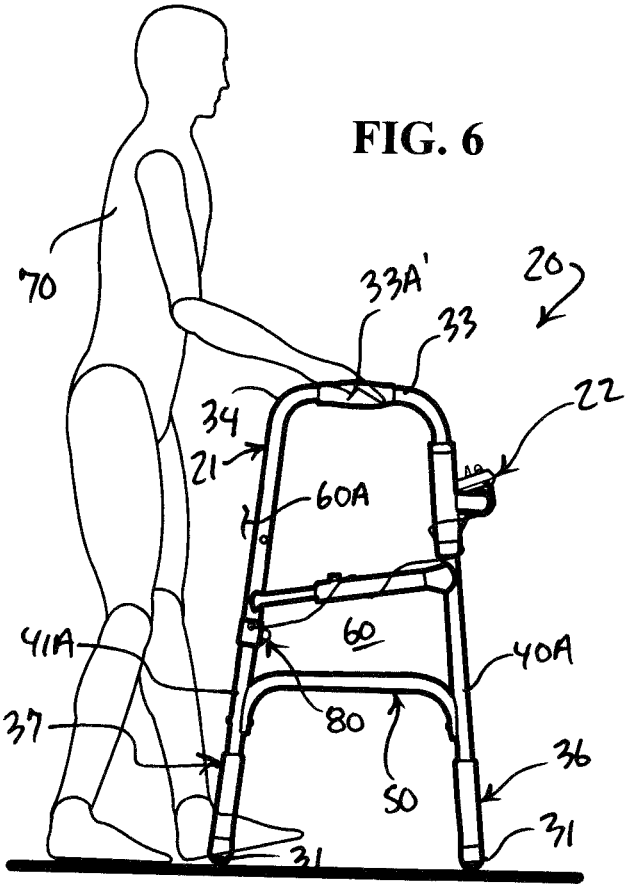
FIGS. 6-9 are side elevation views illustrating the assistive walker of FIG. 1 as it would appear in use.
Figure 7:
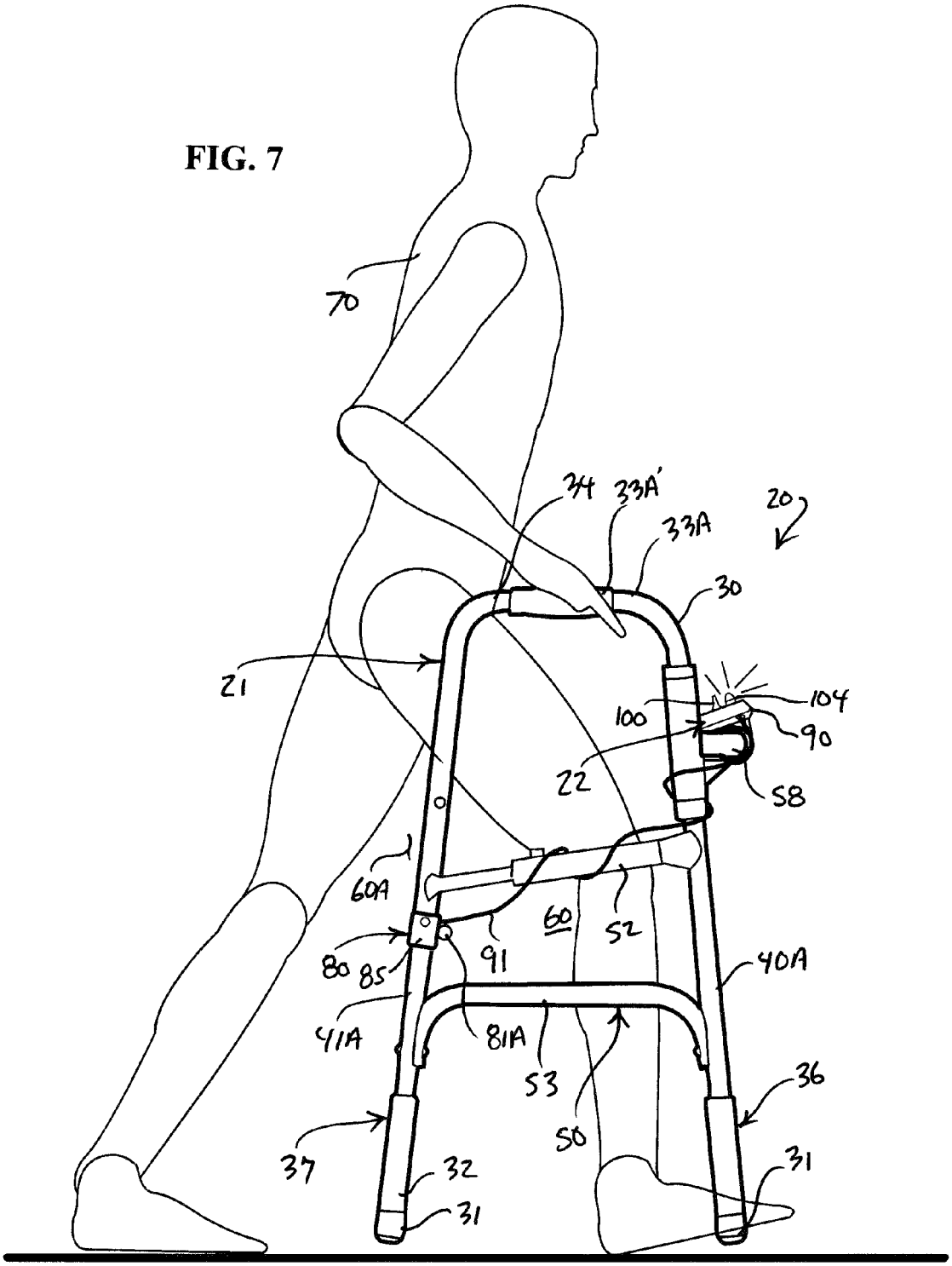

Walker 21 is generally representative of a conventional pickup walker useful in assisting a user in going on foot, further details of which will readily occur to the skilled artisan and will not be discussed in further detail. Walker 21 lets a user keep all or some of his weight off of his lower body with his arms as he takes his steps, i.e., as he goes on foot. To use walker 21 with reference to FIG. 6, walker 21 is placed in front of user 70 with trailing end 37 of walker 21 facing user 70. While confronting trailing end 36 of walker 21, user 70 reaches out with his hand and takes up grips 33A' and 33B' by hand and grips them for support and while holding walker 21 stationary then walks into user-receiving area 60 as shown in FIG. 7 through opening 60A formed in and by trailing end 37 of walker 21 while supporting some or all of his body weight with his arms. While standing after having walked into user-receiving area 60 the user then gently slides or otherwise advances walker 21 forwardly with his arms to a forward position, holds walker 21 stationary at this advanced position, and then again walks into user-receiving area 60 through opening 60A formed in and by trailing end 37 of walker 21 while supporting some or all of his body weight with his arms. This process of going on foot with walker 21 is repeated by the user as the user uses walker 21 to go on foot as described, in which the user repeatedly walks into user-receiving area 60 through opening 60A and advances walker 21, whereby the user will repeatedly encounter user-receiving area 60 and opening 60A, and will repeatedly pass into user-receiving area 60 back-and-forth through opening 60A. As the user uses walker 21 to go on foot, it is important that the user stand substantially upright while holding the handled end of walker 21, and repeatedly walk into and out of user-receiving area 60 through opening 60A as walker 21 is repeatedly advanced for achieving maximum stability and user safety, and this characterizes recommended walker use technique. Use of walker 21 not utilizing recommended walker use technique is improper use of walker 21 and is dangerous and can cause a user to fall.

Figure 8:
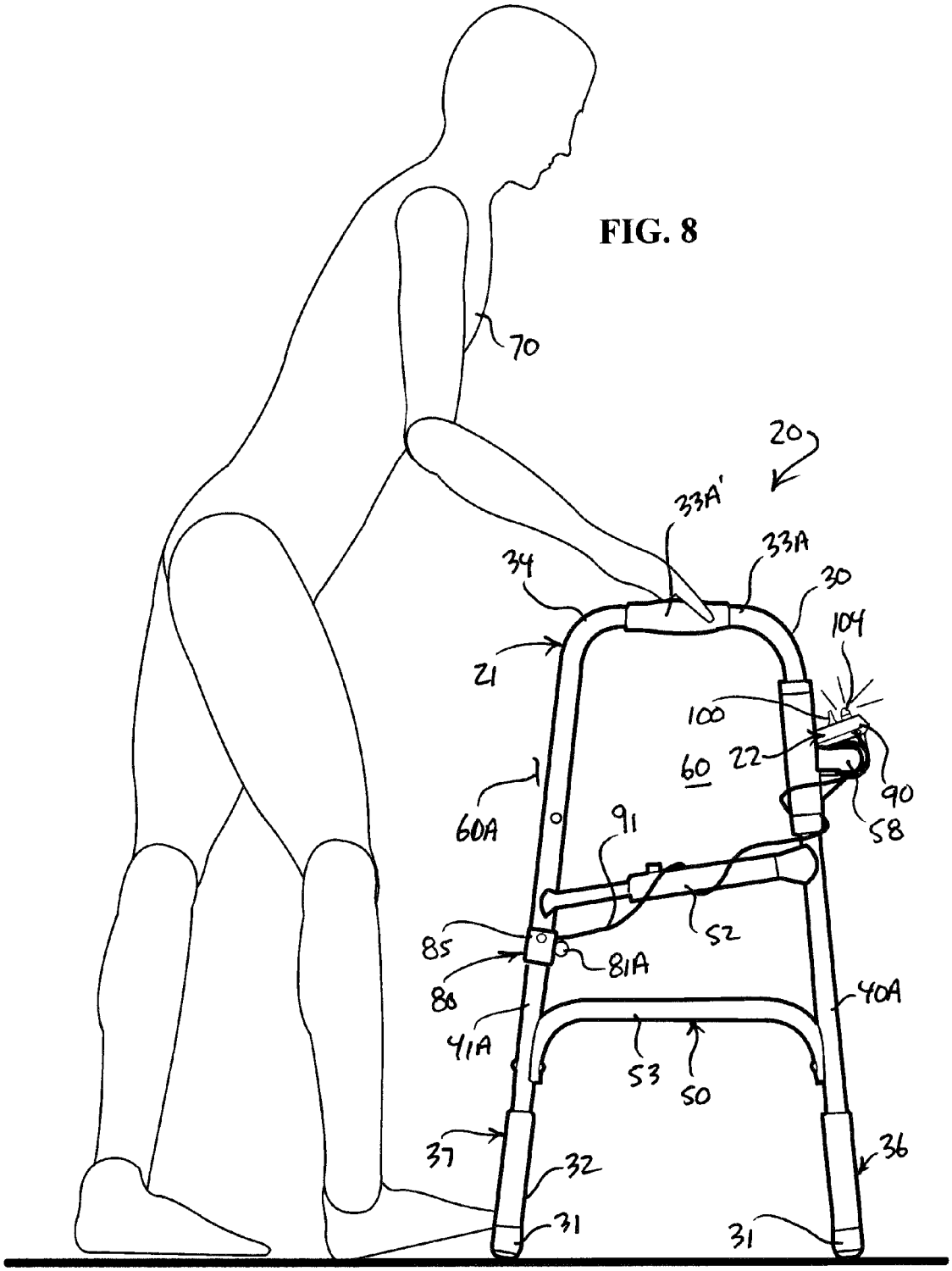
Figure 9:
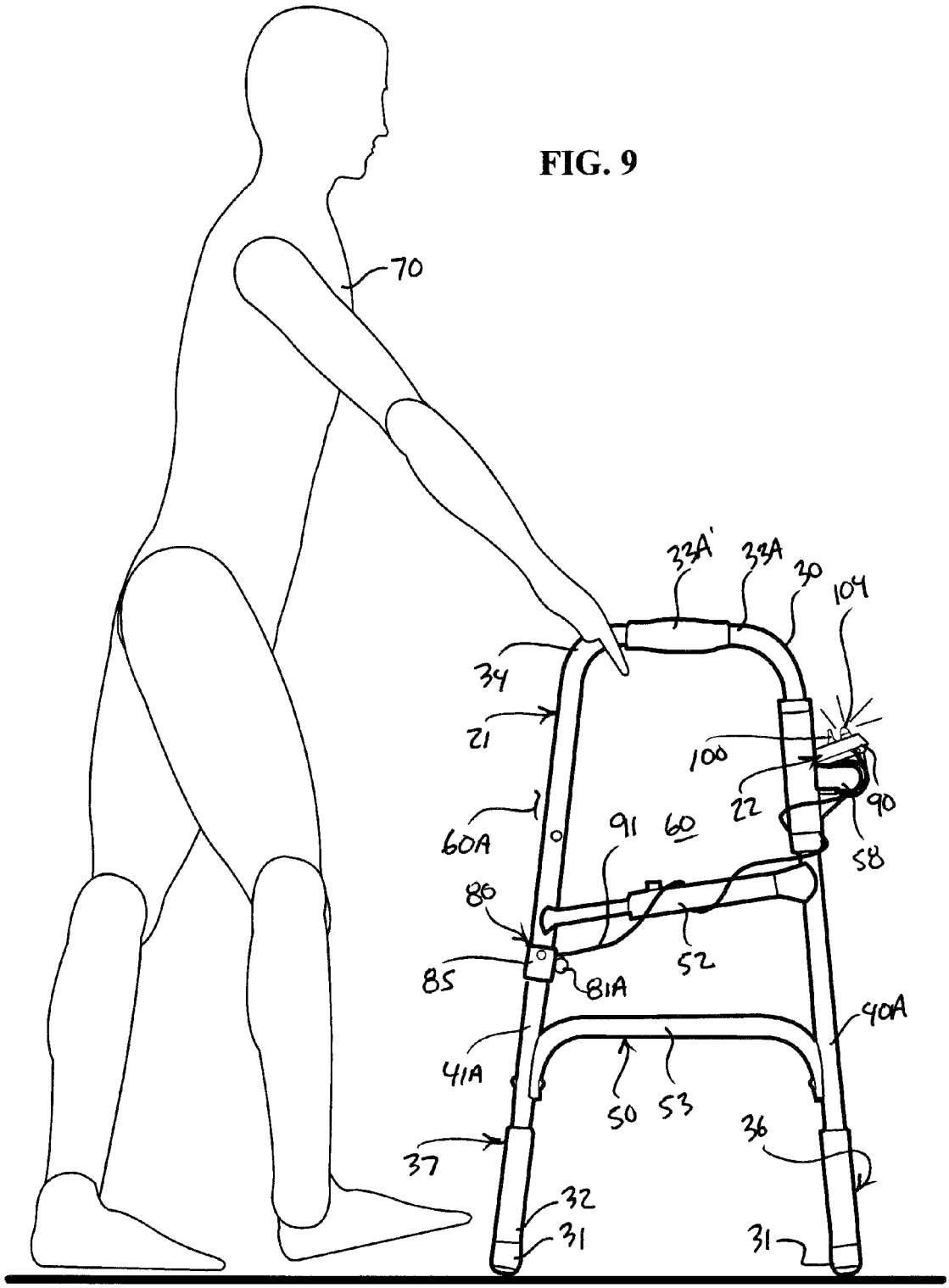

Improper use of a walker, such as walker 21, typically occurs when a user stands and walks too far back of trailing end 37 and fails to repeatedly encounter user-receiving area 60 and opening 60A as described above to provide proper stability. In FIG. 8, user 70 is shown taking up the handled end of walker 21, but is bent over and is depicted walking too far back of trailing end 37, such that as user 70 walks and repeatedly advances walker 21 too far forwardly of his body and does not encounter user-receiving area 60 and opening 60A. In FIG. 9, user 70 is shown taking up the handled end of walker 21, and although is more upright as compared to FIG. 8 is depicted walking too far back of trailing end 37, such that as user 70 walks and repeatedly advances walker 21 too far forwardly of his body does not encounter user-receiving area 60 and opening 60A. Motion sensor apparatus 22 formed in assistive walker apparatus 20 promotes, encourages, or otherwise reinforces recommended walker use technique of walker 21 as discussed in conjunction with FIGS. 6 and 7 to achieve maximum stability and user safety while using walker 21 to go on foot, in accordance with the principle of the invention. According to the principle of the invention, motion sensor apparatus 22 operates to detect user movement at the user-receiving area 60 and to emit a signal/alarm in response to a substantial lack of detected user movement at user-receiving area 60 to alert the user of walker 21 of potential improper use of walker 21, namely, use of walker inconsistent with recommended walker use technique, to allow the user to take corrective action to convert the improper use of walker 21 to proper use, namely, use that is consistent with recommended walker use technique.

Referencing FIGS. 1-3, motion sensor apparatus 22 includes a motion sensor assembly 80, and a signal device operatively coupled to motion sensor assembly 80 to emit the signal in response to a substantial lack of detected user movement by motion sensor assembly 80 at user-receiving area 60 to indicate to the user a use of walker 21 in a manner that is inconsistent with or not recommended walker use technique. Motion sensor assembly 80 consists of opposed sensors 81A and 81B coupled to leg assemblies 50 and 51, respectively, which maintain a beam 82 between them at user-receiving area 60 to detect movement between them at user-receiving area 60 when beam 82 is broken. Sensors 81A and 81B are conventional, readily-available infra-red sensors, and beam 82 maintained by and between sensors 81A and 81B is an infra-red beam.

Sensors 81A and 81B are coupled to leg assemblies 50 and 51, respectively of frame 30 at trailing end 37 of frame 30, and beam 82 maintained by and between sensors 81A and 81B extends across opening 60A of user-receiving area 60. Sensor 81A is coupled to leg assembly 50 at trailing end 37 of frame 30 with a collar 85 encircling and embracing rearward leg 41A of leg assembly 50 between ends 32 and 34 of frame 30, and, more particularly, between upper and lower stretchers 52 and 53. Sensor 81B is, in turn, coupled to leg assembly 51 at trailing end 37 of frame 30 with a collar 86 encircling and embracing rearward leg 41B of leg assembly 51 between ends 32 and 34 of frame 30, and, more particularly, between upper and lower stretchers 54 and 55. Sensors 81A and 81B are located at an intermediate location with respect to ends 32 and 34 of walker 21, and maintain beam 82 across opening 60A of user-receiving area 60 at an intermediate location between ends 32 and 34 of walker 21.

Motion sensor apparatus 22 incorporates a control console 90, which supports various electrically connected electronic components of motion sensor apparatus 22 and which is operatively coupled to sensors 81A and 81B. In the present embodiment, console 90 is operatively coupled to sensors 81A and 81B with conventional electrical wiring 91 supported by frame 30. Console 90 is carried by walker 21, and wiring 91 extends between console 90 and sensors 81A and 81B, is located exteriorly of frame 30, and is wrapped about frame 30 as shown. Wiring 91 can, if desired, be threaded in part or in whole through frame 30 between console 90 and sensors 81A and 81B. In the present example, console 90 is formed at leading end 36 of frame 30 and is attached to and carried by rail 58 at a generally intermediate position between leg assemblies 50 and 51, and this allows console 90 to be easily seen and accessed by a user utilizing assistive walker apparatus 20 in going on foot. Console 90 is coupled to frame 30. Preferably, console 90 is formed with a collar 94 depicted in FIG. 5, which encircles and embraces rail 58 as shown in FIGS. 1 and 2 securing console 90 to rail 58.

Figure 4:
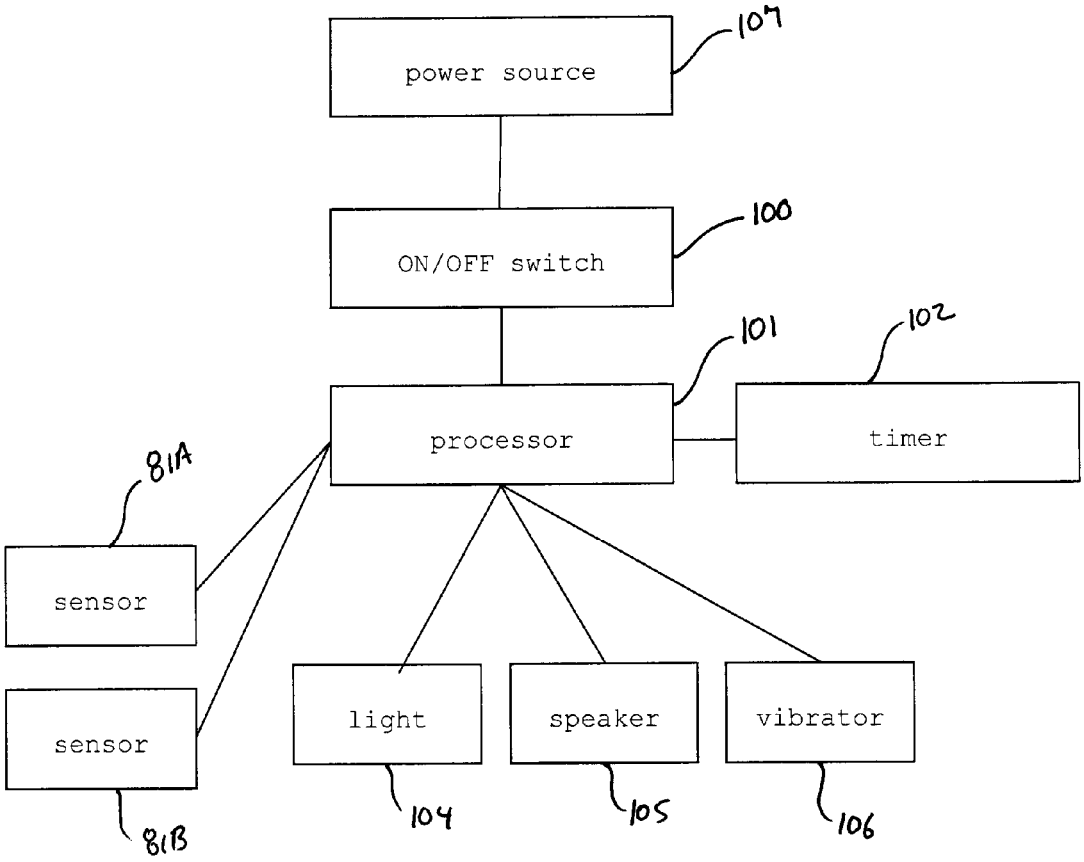
FIG. 4 is a schematic representation of the motion sensor apparatus of the assistive walker of FIG. 1.
Figure 5:
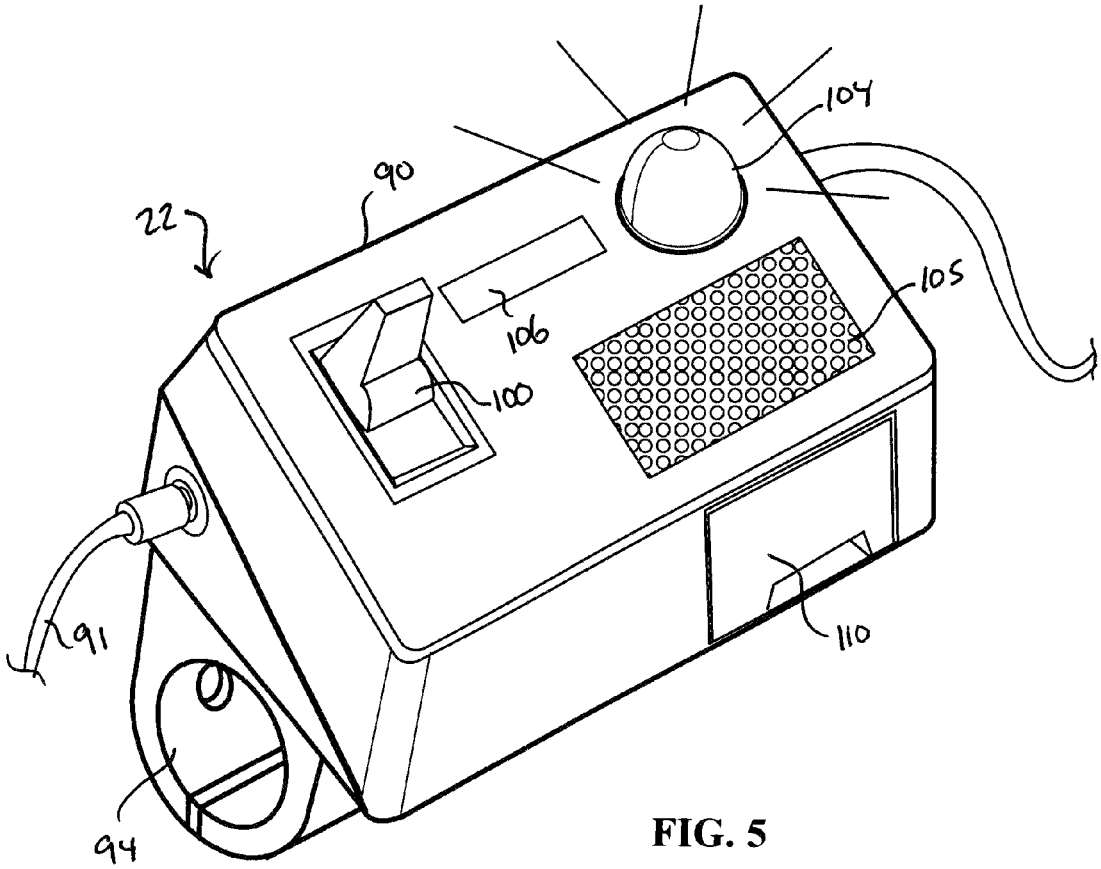
FIG. 5 is an enlarged perspective view of the console of the motion sensor apparatus of the assistive walker of FIG. 1.

In the present example, and with reference in relevant part to FIGS. 4 and 5, the various electronic components supported by control console 90 include an ON/OFF switch 100, a processor 101, a timer 102, signal devices including a light 104, a speaker 105, and a vibrator 106, and a power source 107 that provides electrical power to these components, including sensors 81A and 81B. Power source 107, switch 100, processor 101, timer 102, and the signal devices including a light 104, a speaker 105, and vibrator 106, incorporated in console 90 are electrically connected with conventional electronic circuitry. And so through conventional circuitry incorporated in console 90, processor 101 is operatively coupled to power source 107, to timer 102, to the signal devices including light 104, speaker 105, and vibrator 106, and processor 101 is, in turn, operatively coupled to sensors 81A and 81B with wiring 91. Switch 100 is a conventional and readily available toggle switch movable between an ON position empowering and activating processor 101, timer 102, signal devices including a light 104, a speaker 105, and a vibrator 106, and sensors 81A and 81B, and an OFF position deactivating such components. Processor 101 and timer 102 are conventional and well known devices, light 104 is operative to emit illumination and is preferably a light-emitting diode (LED) or perhaps a plurality of LEDs, speaker 105 is a conventional aural device commonly found in cellular phones and the like that is operative to emit an audible alarm, and vibrator 106 is a conventional device commonly found in cellular phones and the like that is operative to impart a vibrating stimulus or vibration.

Motion sensor apparatus 80 operates in a DC-powered environment, and power source 107 is a DC power source consisting of three conventional AA alkaline batteries. Those having ordinary skill in the art will readily appreciate that any suitable form of battery, including any desired or suitable number of batteries, including one or more rechargeable batteries, may be provided and utilized for the power source onboard console 90. FIG. 5 illustrates battery receptacle cover 110 that leads to a battery receptacle (not shown) formed in console 90 to receive and hold power source 107. Cover 110 may be detached and attached with respect to console 90 as needed for accessing power source 107 for maintenance or replacement.

To employ motion sensor apparatus 22 with walker 21 of assistive walker apparatus 20, switch 100 is moved from its OFF position to its ON position empowering and activating processor 101, timer 102, signal devices including light 104, speaker 105, vibrator 106, and sensors 81A and 81B generating and maintaining beam 82 denoted in FIGS. 1 and 2. At this point, walker 21 is put to use by user 70 in going on foot as described above and as shown in connection with FIG. 7. In response to user 70 using walker 21 in the recommended walker use technique, user 70 will repeatedly encounter user-receiving area 60 and opening 60A, and will repeatedly pass into user-receiving area 60 back-and-forth through opening 60A thus repeatedly breaking beam 82 as user 70 repeatedly passes into user-receiving area 60 back and forth through opening 60A. When beam 82 is broken, motion sensors 81A and 81B thus detect movement at opening 60A of user-receiving area 60, which is indicative that user 70 is using walker 21 according to recommended walker use technique.

Processor 101 is preprogrammed to operate according to the following discussion. In response to breaking beam 82, sensors 81A and 81B generate a sensed or sensing signal, which is sent to and received by processor 101 through the operative coupling between sensors 81A and 81B, and processor 101. In response to receiving this sensed or sensing signal from sensors 81A and 81B, processor 101 is responsive and actuates timer 102, which begins measuring elapsed time. The elapsed time measured by timer 102 is monitored by processor 101. Each time beam 82 is broken, sensors 81A and 81B generate a sensed or sensing signal, which is sent to and received by processor 101. In response to receiving each sensed or sensing signal from sensors 81A and 81B, processor 101 is responsive and re-sets and re-actuates timer 102, which begins measuring elapsed time, which is, again, monitored by processor 101. In the proper use of walker 21, beam 82 will be repeatedly at substantially regular intervals, such as approximately every 5-6 seconds as a matter of example. If beam 82 remains unbroken for a period or duration of time that is the maximum time for the predetermined regular intervals or outside of such predetermined substantially regular intervals, such as approximately 6 seconds or more in the present example, which is a threshold period or duration of time according to the invention constituting and defining a substantial lack of detected user movement at user-receiving area 60, it is determined that walker 21 is no longer being used according to recommended walker use technique and that user 70 is at risk of falling. Accordingly, in response to timer 102 reaching approximately 6 seconds of elapsed measured time from the previous actuation of timer 102 as monitored by processor 101, processor 101 is responsive and actuates the signal devices to alert user 70 of his improper use of walker 21. In response to actuation of signal devices, each emits a signal or alarm design to alert user 70 that use of walker 21 is improper, namely, not consistent with recommended walker use technique. Light 104 emits a visual signal or alarm capable of being seen, speaker 105 emits an audible signal or alarm capable of being heard, and vibrator 106 issues a tactile stimulus signal or alarm capable of being felt.

In response to actuation of light 104 by processor 101, light 104 will illuminate and thus issue illumination capable of being seen providing to user 70 a visual signal or alarm alerting him that his use of walker 21 is not commensurate with recommended walker use technique. The illumination issued by light 104 is bright and intended to be easily seen, and can be a blinking illumination, or a constant illumination as may be desired. In response to seeing this illumination or visual alarm signal issued by light 104, user 70 may then take corrective action to re-assume proper use of walker 21 in accordance with the recommended walker use technique.

In response to actuation of speaker 105 by processor 101, speaker 105, which is an aural device, will activate and issue an alarm noise providing to user 70 an audible signal or alarm alerting him that that his use of walker 21 is not commensurate with recommended walker use technique. In response to hearing this audible signal or alarm issued by speaker 105, user 70 may then take corrective action to re-assume proper use of walker 21 in accordance with the recommended walker use technique. The audible alarm is preferably a shrill, easily heard noise, serious of noises, or pattern of noises, and may also be a pre-recorded verbal message design to communicate use of walker 21 in a manner that is inconsistent with recommended walker use technique and that corrective action is needed to re-assume proper use of walker 21 in accordance with the recommended walker use technique.

In response to actuation of vibrator 106 by processor 101, vibrator 106 will activate and issue vibration, which is a tactile stimulus capable of being felt by user 70 holding the handled end of walker 21 thus providing to user 70 the tactile stimulus, signal, or alarm of vibration alerting him that his use of walker 21 is not commensurate with recommended walker use technique. In response to feeling this tactile signal or alarm of vibration issued by vibrator 106, user 70 may then take corrective action to re-assume proper use of walker 21 in accordance with the recommended walker use technique. Because console 90 is attached to frame 30, the vibration issued by vibrator 106 is sufficiently strong to translate through frame 30 from console 90 to the handled end of walker 21 to be felt by the user's hands holding handles 33A and 33B.

Again, in response to being alerted to improper use of walker 21 by one or more of the issued alarms, user 70 may take corrective action to re-assume use of walker 21 in accordance with recommended walker use technique as described above. By re-assuming recommended walker use technique, user 70 will pass into user-receiving area 60 through opening 60A and thus encounter and break beam 82 formed at opening 60A of user-receiving area 60. In response to this breaking of beam 82 formed at user-receiving area 60, sensors 81A and 81B will generate a sensed or sensing signal, which is sent to and received by processor 101. In response to receiving this sensed or sensing signal from sensors 81A and 81B after an actuation of the signal devices of console 90 by processor 101, processor 101 is responsive and deactivates signal devices and re-sets and re-actuates timer 102, which begins measuring elapsed time, which is, again, monitored by processor 101. In the proper use of walker 21, beam 82 will be repeatedly broken and processor will repeatedly re-set and re-actuate timer 102 as described above. However, every time beam 82 remains unbroken for a period or duration of time that is the maximum time for the predetermined regular intervals or outside of such predetermined substantially regular intervals as explained above, which is the threshold period or duration of time according to the invention constituting a substantial lack of detected user movement, it is determined that walker 21 is no longer being used according to recommended walker use technique and that user 70 is at risk of falling and processor 101 will respond and actuate the signal devices to alert user 70 of his improper use of walker 21 until beam 82 is again broken indicating a resumption of proper use of walker, i.e., use of walker in accordance with recommended walker use technique.

Processor 101 is programmed through conventional programming techniques to activate the signal devices after the threshold period or duration of time as measured by timer 102 has lapsed from the last received sensed or sensing signal from sensors 81A and 81B. In the present example, in the proper use of walker beam 82 will be broken approximately every 5-6 seconds and the threshold period or duration of time is approximately 6 seconds. Depending on the user employing walker 21, in the proper use of walker 21 beam 82 may be broken less than every 5 seconds, or more than every six seconds. According, depending on the interval of beam 82 breakage determined to be indicated of recommended walker use technique for a particular user as some users go on foot with walker 21 faster or slower than others, the threshold period or duration of time may be set at less than 6 seconds or more than 6 seconds, such as 5 seconds, 7 seconds, 8 second, 10 seconds, 12 seconds, 15 seconds, etc. If desired, processor 101 may be conventionally adjustable to permit user adjustment of the threshold period or duration of time. In an alternate embodiment, timer 102 may be programmed with or set to the threshold period or duration of time, and timer 102 may further be conventionally adjustable to allow a user to adjust timer 102 to a selected threshold period or duration of time.

Console 90 is formed with three signal devices, namely, light 104, speaker 105, and vibrator 106, which provide a visual signal or alarm, an audible or aural signal or alarm, and a tactile signal or alarm, each for indicating to a user a use of walker inconsistent with recommended walker use technique, in accordance with the principle of the invention. In other embodiments, processor 101 may be programmed to activate two of the signal devices, or just one of the signal devices as may be desired. In still other embodiments, console 90 may be fashioned with one of light 104, speaker 105, and vibrator 106, or two of light 104, speaker 105, and vibrator 106, to be activated by processor 101 according to the principle of the invention.

In assistive walker apparatus 20, sensors 81A and 81B forming motion sensor assembly 80 are coupled to leg assemblies 50 and 51, respectively, of frame 30 at trailing end 37 of frame 30, and form and maintain beam 82 to detect user movement at user-receiving area 60 and, more particularly, at opening 60A of user-receiving area 60. Sensors 81A and 81B forming motion sensor assembly 80 can be attached to frame 30 of walker 21 at other locations to maintain beam by and between sensors 81A and 81B to detect user movement at not only opening 60A of user-receiving area 60A, but also at selected other locations of user-receiving area 60 where user movement is detectable to indicate use of walker 21 is being made according to or otherwise consistent with recommended walker use technique, in accordance with the principle of the invention.

Figure 10:
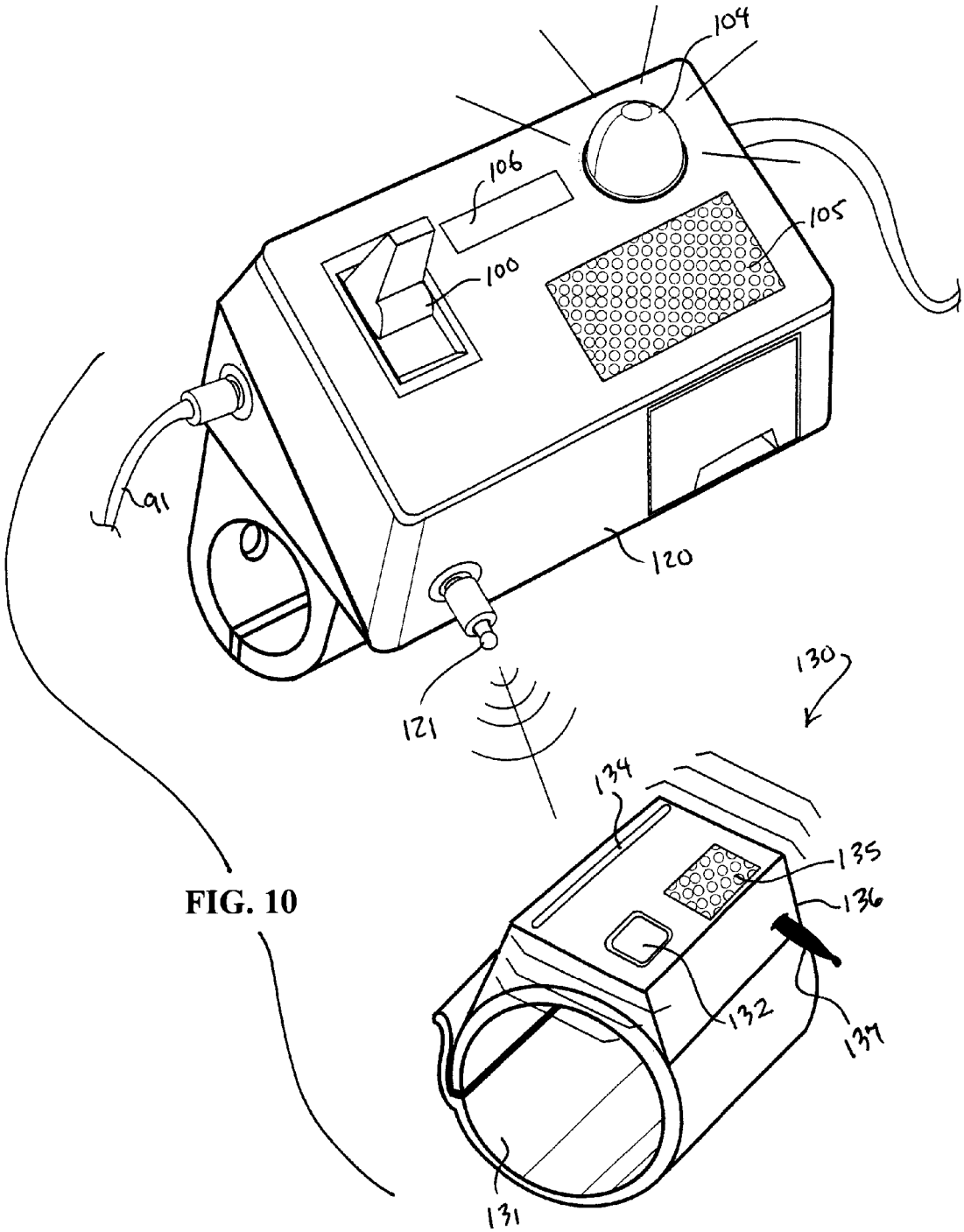
FIG. 10 is an enlarged perspective view of an alternate embodiment of a console wirelessly coupled to an auxiliary alarm apparatus for use with an assistive walker apparatus constructed and arranged in accordance with the principle of the invention.
Figure 12:
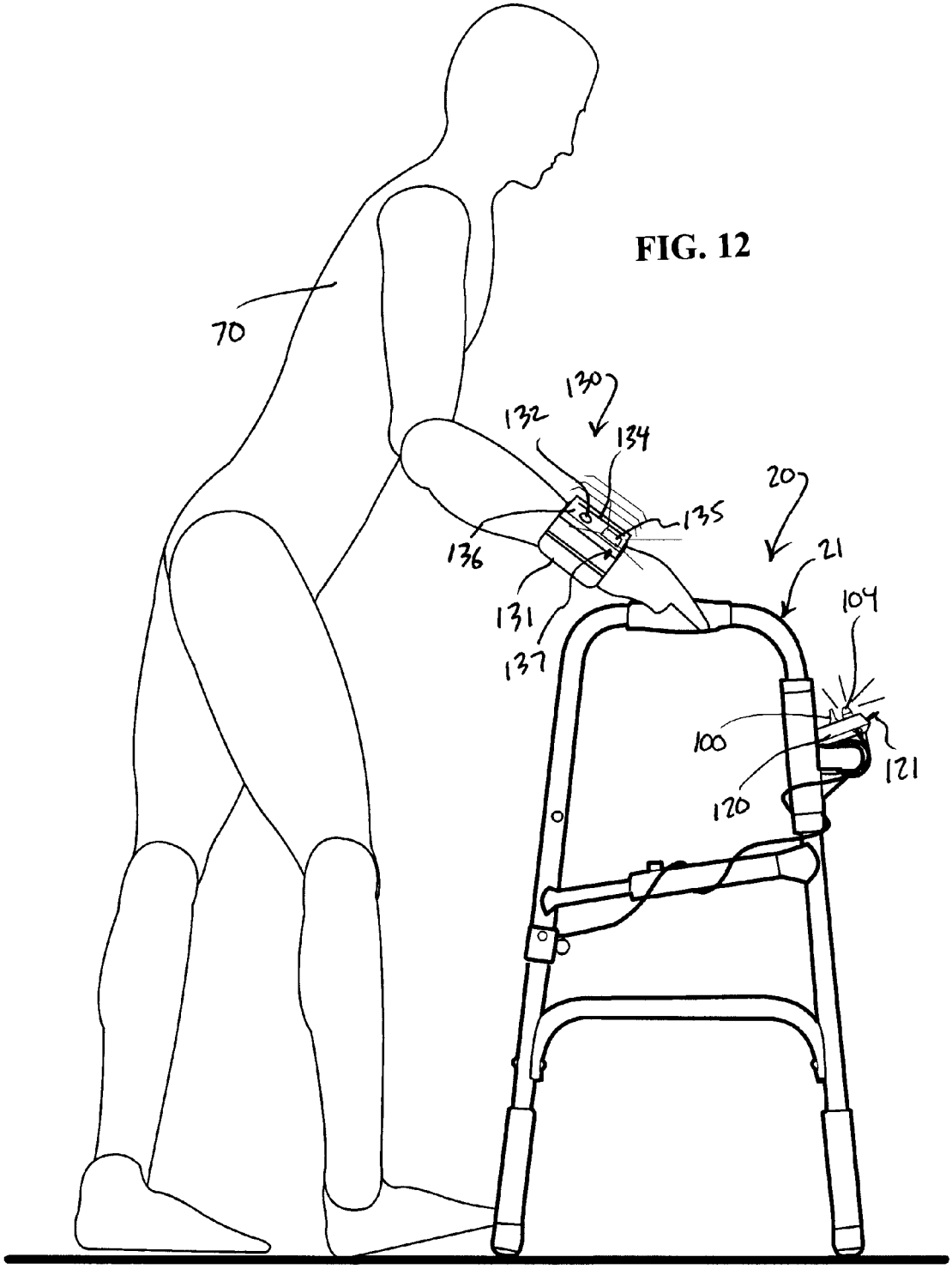
FIG. 12 is a side elevation view of an assistive walker formed with the console of FIG. 10 shown as it would appear in use by a user wearing the auxiliary alarm apparatus.

To further enhance the operational characteristics of assistive walker apparatus 20 and its overall utility, attention is now directed to FIG. 10, which illustrates an alternate embodiment of a console 120 wirelessly coupled to an auxiliary alarm apparatus 130 all for use with assistive walker apparatus 20 constructed and arranged in accordance with the principle of the invention as shown in FIG. 12. Console 120 is identical in every respect to console 90, and with additional reference in relevant part to FIG. 4 is formed with switch 100, processor 101, timer 102, light 104, speaker 105, vibrator 106, and power source 107, and it is to be understood that the foregoing discussion of console 90 applies to console 110 in every respect, save one difference. Unlike console 90, console 120 is formed with a conventional wireless transmitter 121 which is coupled in wireless communication to auxiliary alarm apparatus 130.

Figure 11:
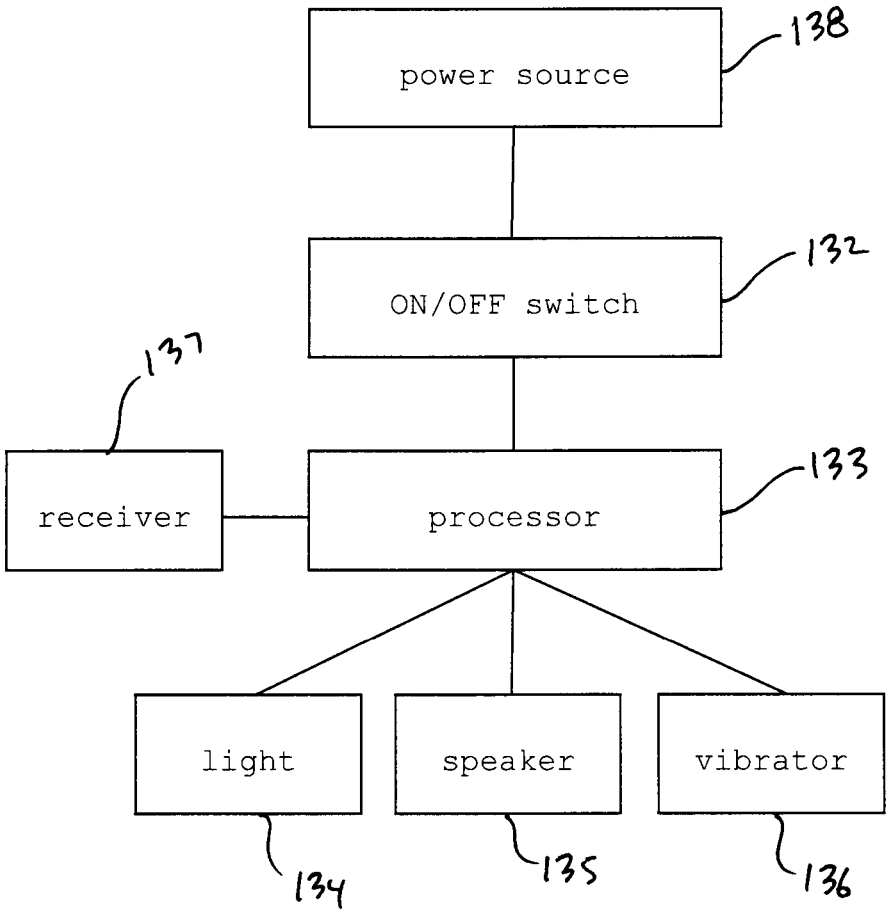
FIG. 11 is a schematic representation of the auxiliary alarm apparatus of FIG. 10.

With attention directed in relevant part to FIG. 10 and also to FIG. 11, which is a schematic representation of auxiliary alarm apparatus 130, auxiliary alarm apparatus 130 consists of a wrist band 131 formed with an ON/OFF switch 132, a processor 133, signal devices including a light 134, a speaker 135, and a vibrator 136, a wireless receiver 137, and a power source 138. Receiver 137 formed in auxiliary alarm apparatus 130 is coupled in wireless communication to transmitter 121 formed in console 120. Switch 132, processor 133, signal devices including light 134, speaker 135, and vibrator 136, wireless receiver 137, and power source 138 are electrically connected with conventional electrical circuitry, and power source 137 provides electrical power to these components. Switch 132 is a conventional toggle switch movable between an ON position empowering and activating processor 133, signal devices including light 134, speaker 135, and vibrator 136, and wireless receiver 137, and an OFF position deactivating such components. Light 134 is operative to emit illumination capable of being seen and is preferably a light-emitting diode, speaker 135 is a conventional aural device commonly found in cellular phones and the like that is operative to emit an audible alarm capable of being heard, and vibrator 136 is a conventional device commonly found in cellular phones and the like that is operative to impart a vibrating stimulus or vibration capable of being felt. Processor 133 is operatively coupled to receiver 137 to receive activation and deactivation signals from receiver 137.

Auxiliary alarm apparatus 130 is preferably operated in a DC-powered environment, and power source 138 is a DC power source consisting of three conventional AAA alkaline batteries. Those having ordinary skill in the art will readily appreciate that any suitable form of battery, including any desired or suitable number of batteries, including one or more rechargeable batteries, may be provided and utilized for the power source onboard auxiliary alarm apparatus 130.

In use, auxiliary alarm apparatus 130 may be worn by user 70 as shown in FIG. 12 by applying wrist band 131 to user's 70 wrist as shown. In response timer 102 of console 120 reaching the threshold period or duration of time measured from a previous actuation of timer 102 as monitored by processor 101, processor 101 is responsive and actuates one or more of the signal devices formed in console 120 to alert user 70 of his improper use of walker 21 as previously explained, and also generates an activation signal which is sent to wireless to receiver 137 of auxiliary alarm apparatus 130 from transmitter 121, and which is received from receiver 137 by processor 133 operatively coupled to receiver 137. Processor 133 is preprogrammed to operate according to the following discussion. In response to receiving an activation signal from receiver 137, processor 133 actuates the signal devices formed in auxiliary alarm apparatus 130 causing them to issue their respective signals/alarms to alert user 70 of his improper use of walker 21.

In response to actuation of light 134 by processor 101, light 134 will illuminate and thus issue illumination capable of being seen providing to user 70 a visual signal or alarm alerting him that his use of walker 21 is not commensurate with recommended walker use technique. The illumination issued by light 134 is bright and intended to be easily seen, and can be a blinking illumination, or a constant illumination as may be desired. In response to seeing this illumination or visual alarm signal issued by light 134, user 70 may then take corrective action to re-assume proper use of walker 21 in accordance with the recommended walker use technique.

In response to actuation of speaker 135 by processor 101, speaker 135, which is an aural device, will activate and issue an alarm noise providing to user 70 an audible signal or alarm alerting him that that his use of walker 21 is not commensurate with recommended walker use technique. In response to hearing this audible signal or alarm issued by speaker 135, user 70 may then take corrective action to re-assume proper use of walker 21 in accordance with the recommended walker use technique. The audible alarm is preferably a shrill, easily heard noise, serious of noises, or pattern of noises.

In response to actuation of vibrator 136 by processor 101, vibrator 136 will activate and issue vibration, which is a tactile stimulus capable of being felt by the wrist of user 70 wearing auxiliary alarm apparatus 130 thus providing to user 70 the tactile stimulus, signal, or alarm of vibration alerting him that his use of walker 21 is not commensurate with recommended walker use technique. In response to feeling this tactile signal or alarm of vibration issued by vibrator 132 of auxiliary alarm apparatus 130 worn by user 70, user 70 may then take corrective action to re-assume proper use of walker 21 in accordance with the recommended walker use technique.

Again, in response to being alerted to improper use of walker 21 by one or more of the issued alarms both by console 120 and also by auxiliary alarm apparatus 130, user 70 may take corrective action to re-assume use of walker 21 in accordance with recommended walker use technique as described above. By re-assuming recommended walker use technique, user 70 will pass into user-receiving area 60 through opening 60A and thus encounter and break beam 82 formed at opening 60A of user-receiving area 60. In response to this breaking of beam 82, sensors 81A and 81B will generate the sensed or sensing signal, which is sent to and received by processor 101. In response to receiving this sensed or sensing signal from sensors 81A and 81B after an actuation of the signal devices of console 120 and also the signal devices of auxiliary alarm apparatus 130, processor 101 is responsive and deactivates signal devices at console 120 and re-sets and re-actuates timer 102, which begins measuring elapsed time, which is, again, monitored by processor 101, and also generates and sends a deactivation signal to transmitter 121, which deactivation signal is sent wirelessly to receiver 137 of auxiliary alarm apparatus 130 from transmitter 121, and which is received from receiver 137 by processor 133 operatively coupled to receiver 137. In response to receiving the deactivation signal from receiver 137, processor 133 is responsive and deactivates the signal devices formed in auxiliary alarm apparatus 130, namely, light 135, speaker 135, and vibrator 136.

And so in the proper use of walker 21 formed with console 120 and auxiliary alarm apparatus 130, beam 82 will be repeatedly broken and processor 101 will repeatedly re-set and re-actuate timer 102 as described above. However, every time beam 82 remains unbroken for approximately the threshold period or duration of time constituting a substantial lack of detected user movement, it is determined that walker 21 is no longer being used according to recommended walker use technique and that user 70 is at risk of falling and processor 101 will respond and actuate the signal devices at console 120 to alert user 70 of his improper use of walker 21, and will send an activation signal that is wirelessly transmitted between console 120 and auxiliary alarm apparatus 130 to actuate the signal devices at auxiliary alarm apparatus 130 to alert user 70 of his improper use of walker 21, until beam 82 is again broken indicating a resumption of proper use of walker, i.e., use of walker in accordance with recommended walker use technique, at which point processor 101 is responsive and will deactivate the signal devices of console 120 and send a deactivation signal to auxiliary alarm apparatus 130 to deactivate the signal devices at auxiliary alarm apparatus 130, according to the principle of the invention.

Auxiliary alarm apparatus 130 can be used in conjunction with or independently of the signal devices formed in console 120. In the present embodiment, auxiliary alarm apparatus 130 is formed with three signal devices, namely, light 134, speaker 135, and vibrator 136, which provide a visual signal or alarm, an audible or aural signal or alarm, and a tactile signal or alarm, each for indicating to a user a use of walker inconsistent with recommended walker use technique, in accordance with the principle of the invention. In other embodiments, processor 133 may be programmed to activate two of the signal devices, or just one of the signal devices as may be desired. In still other embodiments, auxiliary alarm apparatus 130 may be fashioned with one of light 134, speaker 135, and vibrator 136, or two of light 134, speaker 135, and vibrator 136.

The present invention is described above with reference to preferred embodiments. However, those skilled in the art will recognize that changes and modifications may be made in the described embodiments without departing from the nature and scope of the present invention. Various further changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. An ambulatory device for assisting a user in going on foot, comprising:

a walker includes opposed leading and trailing ends, and defines a user-receiving area between the opposed leading and trailing ends and an opening at the trailing end of the walker to the user-receiving area to provide unobstructed user access therethrough to the user-receiving area at the trailing end of the walker, and the walker for supporting and aiding a user in going on foot in the user-receiving area; and a motion sensor apparatus formed with the walker for detecting user movement at the opening at the trailing end of the walker to the user-receiving area, and for emitting an alerting signal in response to a substantial lack of detected user movement by the motion sensor apparatus at the opening at the trailing end of the walker to the user-receiving area for reinforcing recommended walker use technique.

2. The ambulatory device according to claim 1, wherein the motion sensor apparatus includes a light, and the alerting signal is a visual signal issued by the light.

3. The ambulatory device according to claim 1, wherein the motion sensor apparatus includes an aural device, and the alerting signal is an aural signal issued by the aural device.

4. The ambulatory device according to claim 1, wherein the motion sensor apparatus includes a vibrator, and the alerting signal is a vibrating signal issued by the vibrator.

5. A method of assisting a user in going on foot, the method comprising:

providing a walker having opposed leading and trailing ends and that defines a user-receiving area between the opposed leading and trailing ends and an opening at the trailing end of the walker to the user-receiving area to provide unobstructed user access therethrough to the user-receiving area, the walker for supporting and aiding a user in going on foot in the user-receiving area;

providing the walker with a motion sensor apparatus for detecting user movement at the opening at the trailing end of the walker to the user-receiving area, and for emitting an alerting signal;

the user using the walker in going on foot; and the motion sensor apparatus not detecting user movement at the opening at the trailing end of the walker to the user-receiving area during the user using the walker in going on foot, and the motion sensor apparatus issuing the alerting signal in response thereto reinforcing recommended walker use technique.

6. The method according to claim 5, wherein the step of the motion sensor apparatus issuing the alerting signal further comprises the sensor apparatus issuing a visual signal.

7. The method according to claim 5, wherein the step of the motion sensor apparatus issuing the alerting signal further comprises the sensor apparatus issuing an aural signal.

8. The method according to claim 5, wherein the step of the motion sensor apparatus issuing the alerting signal further comprises the sensor apparatus issuing a vibrating signal.

9. An ambulatory device for assisting a user in going on foot, comprising:

a walker includes opposed leading and trailing ends, and defines a user-receiving area between the opposed leading and trailing ends and an opening at the trailing end of the walker to the user-receiving area to provide unobstructed user access therethrough to the user-receiving area at the trailing end of the walker, and the walker for supporting and aiding a user in going on foot in the user-receiving area; and a motion sensor apparatus formed with the walker for maintaining a beam across the opening at the trailing end of the walker to the user-receiving area to detect movement at the opening at the trailing end of the walker to the user-receiving area when the beam is broken in response to user movement at the opening at the trailing end of the walker to the user-receiving area, and for emitting an alerting signal in response to the beam remaining unbroken for a threshold period of time constituting a substantial lack of detected user movement at the opening at the trailing end of the walker to the user-receiving area for reinforcing recommended walker use technique.

10. The ambulatory device according to claim 9, wherein the motion sensor apparatus includes a light, and the alerting signal is a visual signal issued by the light.

11. The ambulatory device according to claim 9, wherein the motion sensor apparatus includes an aural device, and the alerting signal is an aural signal issued by the aural device.

12. The ambulatory device according to claim 9, wherein the motion sensor apparatus includes a vibrator, and the alerting signal is a vibrating signal issued by the vibrator.

13. A method of assisting a user in going on foot, the method comprising:

providing a walker having opposed leading and trailing ends and that defines a user-receiving area between the opposed leading and trailing ends and an opening at the trailing end of the walker to the user-receiving area to provide unobstructed user access therethrough to the user-receiving area, the walker for supporting and aiding a user in going on foot in the user-receiving area;

providing the walker with a motion sensor apparatus for maintaining a beam across the opening at the trailing end of the walker to the user-receiving area to detect movement at the opening at the trailing end of the walker to the user-receiving area when the beam is broken in response to user movement at the opening at the trailing end of the walker to the user-receiving area, and for emitting an alerting signal;

the user using the walker in going on foot; and the beam remaining unbroken for a threshold period of time so as to constitute no user movement at the opening at the trailing end of the walker to the user-receiving area during the user using the walker in going on foot, and the motion sensor apparatus issuing the alerting signal in response thereto reinforcing recommended walker use technique.

14. The method according to claim 13, wherein the step of the motion sensor apparatus issuing the alerting signal further comprises the sensor apparatus issuing a visual signal.

15. The method according to claim 13, wherein the step of the motion sensor apparatus issuing the alerting signal further comprises the sensor apparatus issuing an aural signal.

16. The method according to claim 13, wherein the step of the motion sensor apparatus issuing the alerting signal further comprises the sensor apparatus issuing a vibrating signal.

* * * * *